US006098351A

United States Patent [19]

Mills

[11] Patent Number: 6,098,351

[45] Date of Patent: Aug. 8, 2000

[54] GRADE-LEVEL ROT-RESISTANT SHRINK-WRAPPED WOODEN POSTS

[76] Inventor: Richard E. Mills, 2757 Riverside Dr., Unit 2, Trenton, Mich. 48183

[21] Appl. No.: 08/626,275

[22] Filed: Apr. 4, 1996

[51] Int. Cl.[7] ..... E04C 3/36

[52] U.S. Cl. ..... 52/169.14; 52/514; 52/736.4

[58] Field of Search ..... 52/169.13, 169.14, 52/170, 736.4, 737.5, 297, 515, 517

[56] References Cited

U.S. PATENT DOCUMENTS

| | | | |
|---|---|---|---|
| 1,694,109 | 12/1928 | Tockar | 52/736.4 X |
| 2,724,156 | 11/1955 | Shaw | 52/170 |
| 4,388,787 | 6/1983 | Milbright | 52/298 |
| 4,543,757 | 10/1985 | Cosgrove | 52/297 X |
| 4,799,340 | 1/1989 | Lichau et al. | 52/170 |
| 5,138,806 | 8/1992 | Marx et al. | 52/170 |
| 5,311,713 | 5/1994 | Goodrich | 52/301 |
| 5,315,796 | 5/1994 | Gruhlke | 52/169.13 X |
| 5,503,371 | 4/1996 | Bies | 52/170 X |

*Primary Examiner*—Richard Chilcot
*Attorney, Agent, or Firm*—Brooks & Kushman P.C.

[57] ABSTRACT

A method for decreasing the ground-level rot of wooden fence posts involves shrink-wrapping the portion of the fence post located immediately above and below grade-level with a shrink-wrappable coating or a polymeric sleeve, optionally with an appearance and/or durability enhancing collar. The posts so treated are suitable for installation in high quality wooden fencing and other applications where grade-level rot is a suspected problem.

13 Claims, 1 Drawing Sheet

1
2
3
4
5
6
7
8

21
22
23
24
25
26
27

31
32
33
34
34
35
36

GRADE-LEVEL ROT-RESISTANT SHRINK-WRAPPED WOODEN POSTS

TECHNICAL FIELD

The present invention pertains to wooden decorative fencing. More particularly, the present invention pertains to a method of preventing grade-level rot of wooden fence posts and the like, by encasing portions of a wooden fence post to be installed at or below grade-level, with a water impermeable casing. Preferably, the water impermeable casing comprises shrink-wrapped plastic sheeting.

BACKGROUND ART

In the past two decades, the use of pressure-treated lumber such as WOLMANIZED® lumber has increased remarkably due to its increased resistance to rot. While the underground portions of such WOLMANIZED timbers show greatly increased rot resistance, particularly when encased in cement, problems still occur at grade-level, where the combination of water, sunlight, and microorganisms encourages rot.

Moreover, treated lumber is generally of a different color, and weathers differently from other forms of lumber frequently used for decorative fencing. Consumers frequently dictate that fencing materials be of more attractive natural colored woods such as redwood, cedar, and cypress. However, these untreated timbers are more prone to grade-level rot, which is the frequent source of failure in such fencing materials.

Wooden fence posts, even those of the pressure-treated variety, may be coated with a variety of paints and varnishes to increase their resistance to rot. However, in addition to being only marginally effective, application of these treatments is both time and labor intensive, and moreover, most such coatings do not weather well, resulting in the necessity for frequent repainting.

The effect of grade-level rot is particularly important, as illustrated by U.S. Pat. No. 4,989,834, where upwardly extending wooden fence elements are actually maintained above ground level by specially designed supports, thus preventing ground rot in these upwardly extending elements.

In U.S. Pat. No. 3,562,403 is disclosed resin-coated wooden poles for mounting light standards, prepared by machining a groove into the wooden pole to encourage thorough penetration of rot-preventing chemicals, following which a shielded electrical conduit is placed in one of the grooves, the surface filled with putty or other substance, and the entire pole spray-coated with a mixture of chopped glass fibers and catalyzed polyester resin. The process of U.S. Pat. No. 3,562,403 is an expensive process, and one which is not amenable to in-the-field production. Moreover, the pole thus treated does not have the appearance of a wooden product, but of a plastic pole.

In U.S. Pat. No. 4,516,756 is disclosed a molded plastic sheath which is inserted over the top of an existing fence post to prevent above-ground weathering, and eliminate the step of painting a fence post, for example when installing picket fences. However, such plastic sheathing is ineffectual for eliminating ground level rot, and gives the exposed post a plastic rather than natural wood appearance.

SUMMARY OF THE INVENTION

The present invention pertains to a method of eliminating grade-level rot in wooden fence posts by covering underground and grade-level portions of the fence posts with shrink-wrappable plastic material, which is then shrink-wrapped with the aid of heat to form a water impermeable covering, or by a below grade-level and grade-level encompassing plastic sleeve. In a preferred embodiment, a short length of plastic sheathing may be inserted over the shrink-wrapped fence post to protect the shrink-wrapped exterior from abrasion and penetration by such devices as lawn mowers and weed whips.

DESCRIPTION OF THE PREFERRED EMBODIMENTS

Figure 1:
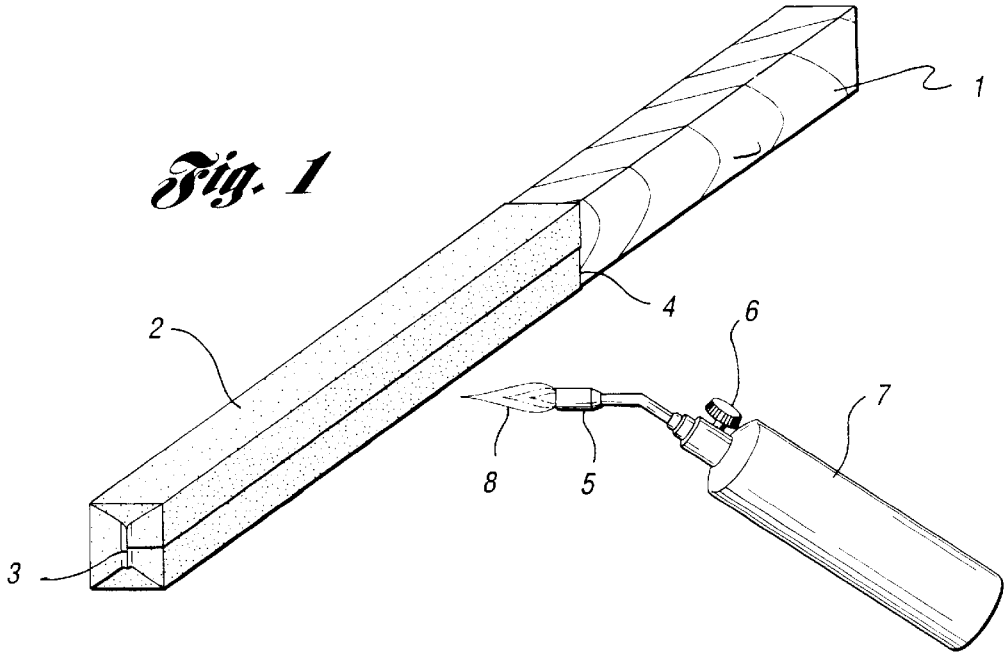
FIG. 1 illustrates a shrink-wrapped fence post, the portion of which to be installed underground and at grade-level is covered with a shrink-wrapped coating.

The fence posts of the subject invention may be of treated or untreated wooden material, as are commonly used for fence posts. The wooden materials may be of pine, fir, cedar, cypress, redwood, oak, or other common wooden fence post materials. These wooden fence posts may be optionally pressure-treated or treated with oily preservatives such as creosote. However, it is preferable that the fence posts, for appearance sake, are untreated materials.

In northern climates, it is common to extend the length of the fence post below the ground to at least below the frost level. This level may vary between 24 and 48 inches, depending upon the locale. In most cases, the fence posts are placed in a hole of larger size than the fence post itself, the annular space between the fence post and the ground being filled with cement. Wooden fence posts, when installed in this manner, have a tendency to rot at grade-level, due to the more or less constant influx of moisture, and the availability of microorganisms at the surface of the ground. Replacement of rotted fence posts is an expensive and time-consuming procedure which can frequently in a loss of business to the contractor due to the consumer's perception that such rotted posts are the result of inferior materials or installation techniques.

It has now been unexpectedly discovered that the simple expedient of wrapping the wooden fence posts with shrink-wrappable material such as is commonly used for the covering of boats during the winter storage months, presents a moisture-impervious barrier and greatly extends the life of fence posts so treated. The shrink-wrap coating should cover at least the portion of the post at or near grade-level, and preferably extends downward from grade-level to the bottom portion of the post to be mounted in the ground and preferably encased in cement. The posts of the subject invention, while preferably used for installation of decorative wooden fencing, are also useful wherever wooden posts are necessary to support a structure, or in other applications. Examples are road guard rail supports, telephone and electrical poles, wooden piles for housing, and the like.

Shrink-wrappable materials are available on the commercial market, and generally consist of oriented thermoplastic sheeting which, when heated by a blow torch, hot air gun, or similar device, shrinks in the orientated direction adhering to itself in the process. Any commonly used shrink-wrappable thermoplastic may be used, for example those of polyvinylchloride, polyvinylacetate, polyolefins, and the like. The shrink-wrappable coating is simply wrapped around the relevant portion of the post, heated with a hot air gun, for example, a propane torch such as Big Red gas torch, supplied by Shrink Wrap Systems, Inc., through which process shrink-wrappable plastic shrinks and seals, forming a moisture impermeable barrier. The bottommost portion of the shrink-wrappable coating located along the bottom of the post, that is, the portion of the post to be inserted furthest below ground, is preferably also sealed by the shrink-wrapping technique. The post, thus shrink-wrapped, is then inserted into the hole in the ground, and earth or cement used to fill the hole. For appearance, the shrink-wrapped coating may be trimmed with a knife blade or like device preferably to a length such that 0.5 to 2 inches of the shrink-wrapped coating extends above grade-level.

To ensure maximum resistance to water and other elements of rot, it is desirable to surround the shrink-wrap coating over that portion of the post which extends above the ground, with a sheath or collar of metal or plastic material to prevent the shrink-wrapped coating from being cut or abraded through the action of lawn mowers, weed whips, and the like. Such collars are generally of a dimension similar to that of the post, in other words, loose enough to be inserted easily over the post, but close enough to the post to prevent substantially movement, and are sized in length such that the collar does not extend appreciably above the shrink-wrap coating, in order to minimize the affect on the appearance on the natural wood of the post. The thickness of the collar material may, in the case of plastic collars, range from 0.03 inch to 0.25 inch, preferably 0.06 inch to 0.125 inch. Metal collars may be of thinner material.

In FIG. 1 is shown a shrink-wrapped fence post. The fence post 1, made of wood such as preferably redwood, or cedar, is wrapped with a shrink-wrappable material 2. A propane gas torch 5 connected to propane cylinder 7 through valve 6 is used to supply a hot air/flame 8 which shrinks the shrink-wrapped material, forming an impervious moisture barrier around the post. At the bottom of the post at 3, the shrink-wrap material is crimped and heated to seal the bottom portion of the post. Preferably, the shrink-wrapped material is cut neatly around the post at 4, this level of cut being above grade-level.

Figure 2:
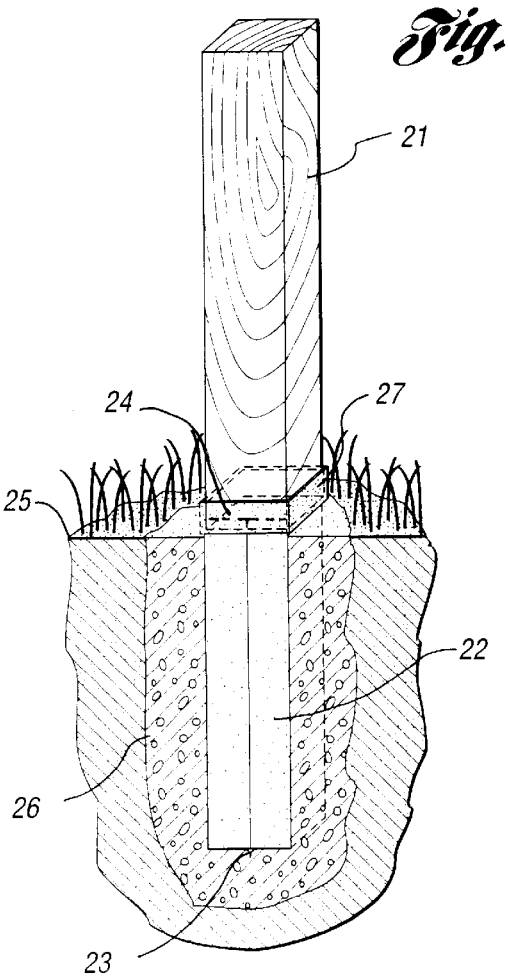
FIG. 2 illustrates a preferred embodiment of the subject invention wherein a short plastic sheath is affixed to the post superficial to the shrink-wrapped showing the placement of the covering with respect to the concrete casing normally used in northern climates.

FIG. 2 illustrates a post inserted into the ground in a cement encasement, including an optional sheath or collar to prevent damage to the shrink-wrapped coating. At 21 is the fence post material, and at 22 the shrink-wrapped material is cut off above ground level at 24. At 23 is shown the bottom portion of the shrink-wrap material being crimped and sealed to prevent ingress of moisture through the bottom of the post. The post is surrounded by concrete 26 and above the level of the ground 25 is surrounded by a loose-fitting collar 27 to protect the shrink-wrapped coating from abrasion.

Figure 3:
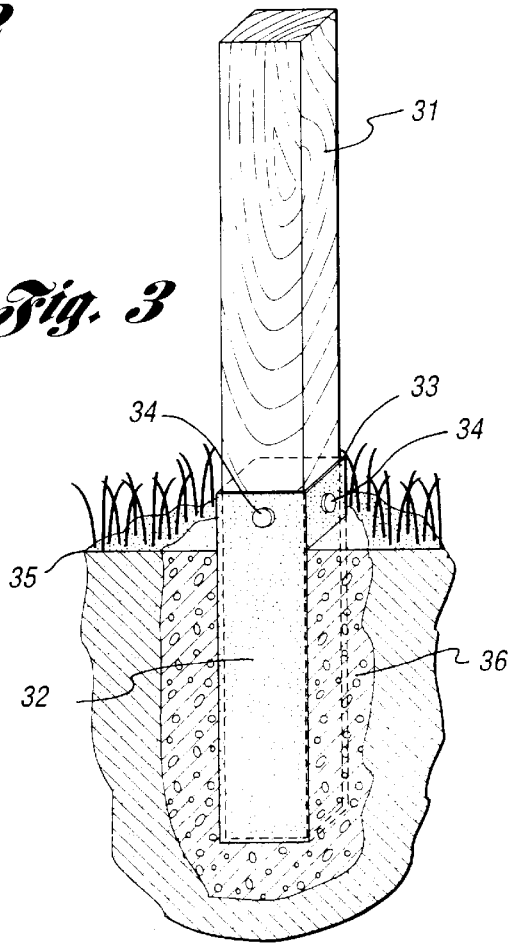
FIG. 3 illustrates an alternative embodiment of the subject invention, wherein a plastic sleeve is used to encapsulate the post over the portions below and at grade-level.

In FIG. 3 is shown an alternative embodiment of the subject invention wherein the wooden fence post 31 is covered by a polymeric sleeve 32 which extends above grade 35 to height 33, protecting the post from grade-level rot. At 34 are shown optional weep holes to prevent water from accumulating at grade-level where the polymeric sleeve provides for any substantial amount of clearance between fence post 31 and sleeve 32. The fence post is shown mounted in cement 36. The polymeric sleeve as shown in FIG. 3 may be an extruded polyvinylchloride plastic sleeve of dimensions slightly larger than the post for easy insertion, may be an oriented extruded plastic sleeve capable of being shrunk around the post through the application of heat, as in the case of shrink-wrappable materials, or may be an elastomeric sleeve which may be stretched and pulled over the post. While it is preferable that such polymeric sleeves be coextensive with the length of the post to be inserted into the ground below grade-level, the sleeve may be terminated above the bottom of the post while still retaining the greatest degree of its efficiency in preventing ground-level rot, provided that the sleeve terminates above ground-level. Such polymeric sleeves may be used optionally with the collar shown in FIG. 2, or may itself act as the collar when the polymeric sleeve material is of substantial thickness. The optional collar is preferably used when the sleeve is of elastomeric material, as such elastic materials are generally inferior in resistance to the effects of sunlight and the elements as opposed to sleeves made of substances such as polyolefin or polyvinylchloride.

Having now fully described the invention, it will be apparent to one of ordinary skill in the art that many changes and modifications can be made thereto without departing from the spirit or scope of the invention as set forth herein.

What is claimed is:

1. A method for decreasing grade-level rot in wooden fence posts, said method comprising:

wrapping a shrink-wrappable thermoplastic polymer sheeting material around a wooden fence post;

heating said shrink-wrappable thermoplastic sheeting to adhere said sheeting to itself, whereby said sheeting shrinks to form a shrink-wrapped polymer integument in direct contact with said fence post such that the entire inner surface of said integument is in an abutting relationship with said post; disposing a first end of said shrink-wrapped fence post in a fence post hole such that said shrink-wrapped thermoplastic polymer integument extends from said first end of said fence post to a point above grade level.

2. The method of claim 1 wherein said wooden fence post comprises a fence post of untreated wood.

3. A grade-level rot-resistant wooden post comprising a wooden post having an above grade-level portion merging with a below grade level portion, and a shrink-wrapped polymer integument extending from the bottom of said below grade level portion of said post to beyond a point of merger between said below grade-level portion and said above grade-level portion, the entire inner surface of said shrink-wrapped polymer integument in an abutting relationship with said wooden post, said shrink-wrapped polymer integument prepared by wrapping a shrink-wrappable thermoplastic polymer sheeting around said post and heating to shrink said shrink-wrappable thermoplastic polymer sheeting and to adhere said sheeting to itself.

4. The grade-level rot-resistant post of claim 3 wherein said wooden post comprises untreated wood.

5. A grade-level rot-resistant wooden post comprising a wooden post having an above grade-level portion merging with a below grade level portion, and a shrink-wrapped polymer integument extending from the bottom of said below grade level portion of said post to beyond a point of merger between said below grade-level portion and said above grade-level portion, said shrink-wrapped polymer integument prepared by inserting said post into a shrinkable oriented extruded plastic sleeve and heating said sleeve such that said plastic sleeve shrinks onto said post whereby the entire inner surface of said integument is in an abutting relationship with the wood of said wooden post.

6. The grade-level rot-resistant wooden post of claim 5 wherein said wood comprises untreated wood.

7. A method for decreasing grade-level rot in wooden fence posts, said method consisting of:

wrapping a shrink-wrappable thermoplastic polymer sheeting material around a wooden fence post;

heating said shrink-wrappable thermoplastic sheeting to adhere said sheeting to itself, whereby said sheeting shrinks to form a shrink-wrapped polymer integument in direct contact with said fence post; disposing a first end of said shrink-wrapped fence post in a fence post hole such that said shrink-wrapped thermoplastic polymer integument extends from said first end of said fence post to a point above grade level.

8. The method of claim 7 wherein the wood of said wooden fence post is untreated wood.

9. A grade-level rot-resistant wooden post assembly consisting of a wooden post having an above grade-level portion merging with a below grade level portion, and a shrink-wrapped polymer integument extending from the bottom of said below grade level portion of said post to beyond a point of merger between said below grade-level portion and said above grade-level portion, said shrink-wrapped polymer integument directly abutting the wood of said wooden post, said shrink-wrapped polymer integument prepared by wrapping a shrink-wrappable thermoplastic polymer sheeting around said post and heating to shrink said shrink-wrappable thermoplastic polymer sheeting and to adhere said sheeting to itself.

10. The grade-level rot-resistant post of claim 9 wherein the wood of said wooden post is untreated wood.

11. A grade-level rot-resistant wooden post consisting of a wooden post having an above grade-level portion merging with a below grade level portion, and a shrink-wrapped polymer integument extending from the bottom of said below grade level portion of said post to beyond a point of merger between said below grade-level portion and said above grade-level portion, said shrink-wrapped polymer integument prepared by inserting said post into a shrinkable oriented seamless extruded plastic sleeve and heating said sleeve such that said plastic sleeve shrinks onto said post whereby said integument directly abuts the wood of said wooden post.

12. The grade-level rot-resistant wooden post of claim 11 wherein said wood is untreated wood.

13. A method for decreasing ground level rot in wooden posts set into the ground, said method comprising:

selecting a shrinkable, oriented thermoplastic sheet material;

wrapping said thermoplastic sheet material around the portion of a wooden post such that the thermoplastic sheeting material will extend above grade level when said post is set into the ground, and said thermoplastic sheeting material overlaps with itself;

shrink wrapping said thermoplastic sheeting material by applying heat to shrink said thermoplastic sheet material onto said post and to seal overlapping portions of said thermoplastic sheet directly to itself;

wherein following shrink wrapping, said thermoplastic sheet material is in a direct abutting relationship to the wood of said post.

* * * * *